US005810197A

United States Patent [19]

Mazzarolo

[11] Patent Number: 5,810,197

[45] Date of Patent: Sep. 22, 1998

[54] PLASTIC CONTAINER AND LID WITH TAB

[76] Inventor: Ivonis Mazzarolo, 545 Chemin de l'Anse, Vaudreuil, Québec, Canada, J7V 8P3

[21] Appl. No.: 741,253

[22] Filed: Oct. 30, 1996

[51] Int. Cl.[6] ..... B65D 43/04

[52] U.S. Cl. ..... 220/805; 220/359; 229/125.17; 229/160.2; 229/117.2

[58] Field of Search ..... 220/793, 805, 220/784, 785, 786, 799–802, 366.1, 359; 229/117.22, 125.17, 160.2, 4.5, 125.09, 125.08

[56] References Cited

U.S. PATENT DOCUMENTS

| | | | |
|---|---|---|---|
| 1,403,571 | 1/1922 | Schneider | 220/805 X |
| 3,044,610 | 7/1962 | Tupper | 220/802 X |
| 3,173,571 | 3/1965 | Cserny et al. | 220/785 X |
| 3,204,813 | 9/1965 | McCuskey et al. | 220/793 X |
| 3,651,981 | 3/1972 | Kinney | 220/785 X |
| 3,672,536 | 6/1972 | Kinney et al. | 220/785 X |
| 3,749,277 | 7/1973 | Kinney | 220/785 |
| 5,052,578 | 10/1991 | Goodwin | 220/254 X |
| 5,472,542 | 12/1995 | Wermund | 215/321 X |

FOREIGN PATENT DOCUMENTS

| | | | |
|---|---|---|---|
| 2572055 | 4/1986 | France | 220/259 |

*Primary Examiner*—Allan N. Shoap
*Assistant Examiner*—Nathan Newhouse
*Attorney, Agent, or Firm*—Joseph W. Molasky & Associates

[57] ABSTRACT

The disclosure describes the combination of a plastic container and of a plastic lid which are adapted to be hermetically sealed to one another. The lid defines a tab that projects outwardly and includes a tangentially extending indentation that separates the tab into an inner portion and an outer portion. The indentation forms a hinge so that upward forces exerted accidentally on the tab causes only the outer portion of the tab to pivot about the indentation thereby preventing the inner tab portion from lifting and detaching the hermetically sealed lid portion from the container. The hinge also serves to enable the tab to be placed in a downwards pivoted position where it is fixedly attached to the container side wall prior to being used.

2 Claims, 2 Drawing Sheets

PLASTIC CONTAINER AND LID WITH TAB

FIELD OF THE INVENTION

The present invention pertains to plastic containers and lids which are hermetically sealed to one another with a set adhesive.

BACKGROUND OF THE INVENTION

Various reusable plastic containers and plastic lids which are hermetically sealed to one another are known. For example, one such combination of a reusable plastic container and plastic lid therefor is described in U.S. Pat. No. 4,215,797 issued Aug. 5, 1980 to Chen. These containers and lids are used in the packaging of perishable goods, such as meat and dairy products, medicinal and cosmetic products.

Some plastic containers use non-reusable lids, such as the aluminum foil lid which is torn off the container, the latter being thereafter discarded since the goods of the containers are entirely consumed. In other cases, a separate lid must be used to close the container if the goods are to be kept for future use.

Many of the reusable plastic lids used are rigid to ensure the adequate reclosing of the lid to the container.

Some of these rigid lids have an outwardly projecting tab. It has been found that, on many occasions, during transport or simple manipulation, the protruding tab is accidentally contacted, or lifted, and, because it is rigid, part of the hermetically sealed area between container and lid becomes detached.

OBJECT AND STATEMENT OF THE INVENTION

It is an object of the present invention to overcome the above described problem associated with plastic containers and lids therefor. This is achieved by providing, on the tab of the lid, an indentation which will enable a portion of the tab to be pivoted in order to, in one case, to flex under the upward forces exerted by accidental shocks and, in another case, to take a position, prior to being used, which will reduce these accidental hits on the tab. In the first case, the forces exerted on an outer part of the tab are not transmitted to the sealed area between the container and the lid because of the indentation, which acts as a hinge between the outer tab part and the remaining part of the lid adjacent the sealed area.

The present invention therefore pertains to a plastic lid which consists of a circular body displaying an annular portion adapted to be hermetically sealed to the annular rim portion of a container. The lid portion has an outwardly projecting tab integral with the lid portion, the tab displaying a tangentially extending indentation defining an outer part and an inner part.

In one form of the invention, the indentation defines a hinge whereby upward forces exerted on the outer tab part causes it to pivot about the indentation thereby preventing the inner tab part from lifting and detaching the hermetically sealed lid portion from the container rim portion.

In another form of the invention, the indentation defines a hinge whereby the tab outer part may be pivoted downward and be affixed to the container side wall from which it can be detached whenever it is wished to remove the lid from the container.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
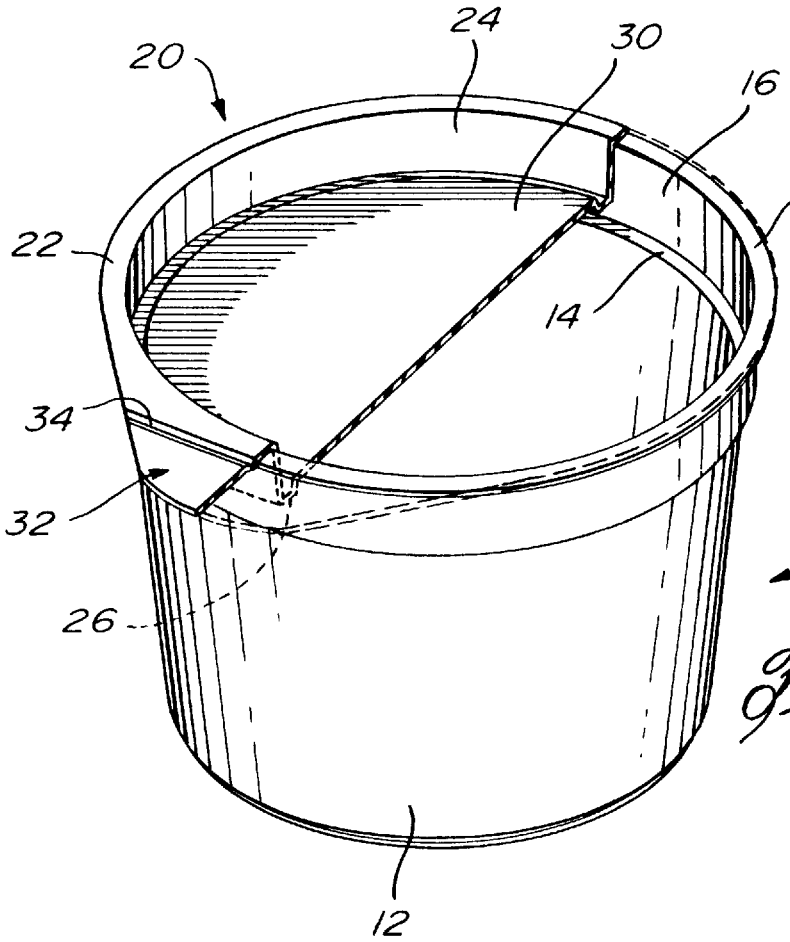
FIG. 1 is a perspective view of a container having a sealed lid thereon, a portion of the lid having been removed to show details of the container lid engagement.

Referring to FIG. 1, there is shown a circular plastic container 10 having an outwardly sloping side wall 12 merging into a rim shoulder 14 which continues upwardly into an inwardly sloping annular wall portion 16 which merges into a rim portion 18.

Figure 2:
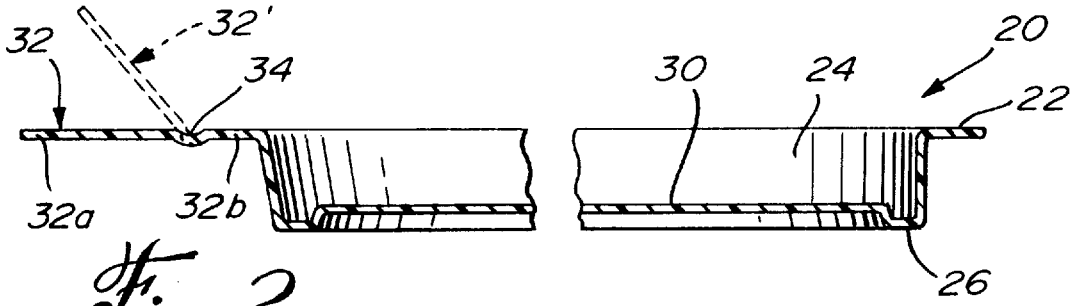
FIG. 2 is a cross-sectional view of the lid.

Referring also to FIG. 2, a complementary lid 20 has an outwardly projecting lip portion 22, downwardly extending annular portion 24 with a lid indent 26. The indent merges into a lid base 30. Although made of resilient plastic material, the lid has some rigidity so that it may be reused by replacing it in engagement with the container.

Figure 3:
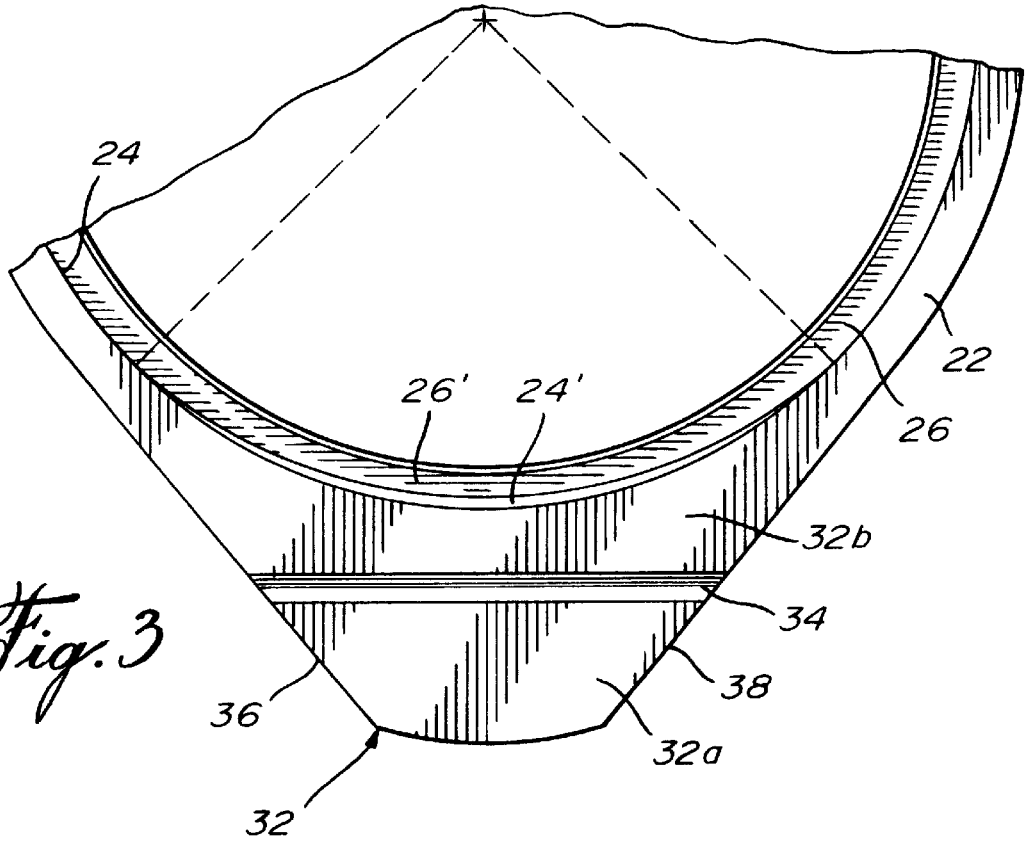
FIG. 3 is an enlarged bottom plan view of the lid in the tab area.

The projecting lip portion 22 of the lid has an outwardly projecting tab 32 displaying an indentation 34 that defines an outer tab part 32*a* and an inner tab part 32*b*. As can be seen in FIG. 3, the indentation 34 extends tangentially to the circular rim indent 26 from side edge 36 to the opposite side edge 38 of the tab 32.

There are various processes in hermetically sealing the annular rim 18 of the container to the under face of the annular lip portion 22 of the lid. One method may consist of vacuum thermoforming the lid from a sheet of plastic wherein the entire underside of the lid is coated with a hot melt adhesive; alternatively, only those area to be sealed are provided with the adhesive. The manner in which the hermetic seal is achieved is not the object of the present invention.

As illustrated in FIG. 2, any accidental upward forces exerted on the tab 32 will result in tab part 32*a* pivoting about the indentation 34, which acts as an hinge, to adopt the position 32' shown in dotted lines. However, these accidental forces are not transmitted to the inner part 32*b*, thus ensuring that the seal between the container and lid is not separated as a result of these forces.

Another feature of the present invention is to provide easy removal of the lid from the container when such removal is desired. This is achieved by reducing somewhat the width of the indent 26 in its segment 26' and in slightly increasing the outward slope of the downwardly extending annular portion 24' in this area. Hence, by increasing the slope, the frictional engagement between wall 24' and wall 26' of the container is reduced.

Figure 4:
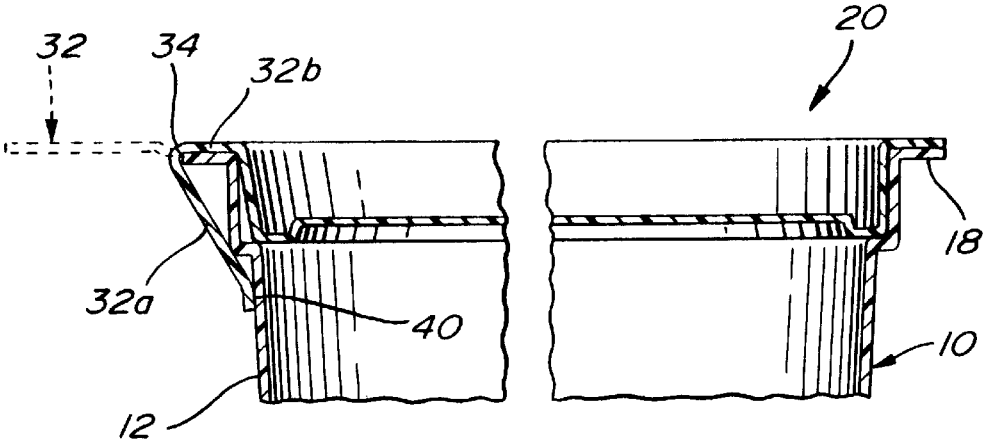
FIG. 4 is a cross-sectional view showing another embodiment of the present invention.

FIG. 4 shows another use of the lid 20 made in accordance with the present invention. The provision of the hinge 34 allows the tab part 32*a* to be pivoted downwards and be affixed at 40 by adhesive bonding or otherwise, to the side wall 12 of the container 10.

Although the invention has been described above with respect with one specific form, it will be evident to a person skilled in the art that it may be modified and refined in various ways. For example, the indentation which has been illustrated in the drawings as being a groove in the top face of the tab may also be a groove in the bottom face of the tab. It is therefore wished to have it understood that the present invention should not be limited in scope, except by the terms of the following claims.

The embodiments of the invention in which an exclusive property or privilege is claimed are defined as follows:

1. In combination, a plastic container and a plastic lid, a) said plastic container comprising a bottom wall and a sloping side wall merging into an annular rim portion; said sloping side wall including a rim shoulder merging into a sloping annular inner wall portion;

b) said plastic lid comprising a circular body displaying an annular lid portion for being hermetically sealed to said annular rim portion of said container; said container inner wall portion merging with said rim portion; said circular body comprising a central lid base displaying an annular seat continuous with an annular sloping wall merging into said lid portion; said lid portion having an integral outwardly projecting tab wherein said sloping wall of said lid in the area beneath said tab has greater inclination than that of the remaining portion of said sloping side wall of said lid; said tab displaying a tangentially extending indentation defining an outer tab part and an inner tab part; said indentation defining a hinge whereby upward forces exerted on said outer tab part causes said outer tab part to pivot about said indentation and, when said container and lid are hermetically sealed to one another, to prevent said inner tab part from lifting and a hermetically sealed lid portion adjacent said outer part from detaching from said container rim portion.

2. In combination, a plastic container and a plastic lid, a) said plastic container comprising a bottom wall and a sloping side wall merging into an annular rim portion; said sloping side wall including a rim shoulder merging into a sloping annular inner wall portion; said inner wall portion merging with said container rim portion;

b) said plastic lid comprising a circular body displaying an annular lid portion for being hermetically sealed to said annular rim portion of said container; said lid portion comprising a central lid base displaying an annular seat continuous with an annular sloping wall merging into said lid portion; said seat of said lid resting on said shoulder of said container; said lid portion having an integral outwardly projecting tab; said tab displaying a tangentially extending indentation defining an outer tab part and an inner tab part; said indentation defining a hinge whereby said outer tab part may be pivoted downwards to be affixed to said side wall of said container from which it may be subsequently detached whenever the lid is removed from the container, wherein said sloping wall of said lid in the area beneath said tab has greater inclination than that of the remaining portion of said sloping side wall of said lid.

* * * * *